US010791591B1

(12) United States Patent
Gariglio

(10) Patent No.: US 10,791,591 B1
(45) Date of Patent: Sep. 29, 2020

(54) ROTARY HEATING APPARATUS, AND METHODS OF MAKING AND USING SAME

(71) Applicant: Gary M Gariglio, Metamora, MI (US)

(72) Inventor: Gary M Gariglio, Metamora, MI (US)

( * ) Notice: Subject to any disclaimer, the term of this patent is extended or adjusted under 35 U.S.C. 154(b) by 392 days.

(21) Appl. No.: 15/702,675

(22) Filed: Sep. 12, 2017

Related U.S. Application Data

(60) Provisional application No. 62/395,435, filed on Sep. 16, 2016.

(51) Int. Cl.
*H05B 6/10* (2006.01)
*H05B 6/40* (2006.01)

(52) U.S. Cl.
CPC ..... *H05B 6/102* (2013.01)

(58) Field of Classification Search
CPC ... C21D 1/42; C21D 1/10; C21D 9/02; H05B 6/101; H05B 6/36; H05B 6/40; F16F 1/00; Y02P 10/253
USPC ..... 219/652, 602, 635, 636, 642, 647, 648, 219/653, 656, 673, 674, 676; 266/129, 266/130, 259; 267/69, 70, 71, 73, 74; 432/11, 124
See application file for complete search history.

(56) References Cited

U.S. PATENT DOCUMENTS 2,495,193 A * 1/1950 Wells ..... H05B 6/40 219/635
2012/0234824 A1* 9/2012 Nakatsu ..... C21D 9/0025 219/600

* cited by examiner

*Primary Examiner* — Quang T Van
(74) *Attorney, Agent, or Firm* — The Weintraub Group, P.L.C.

(57) ABSTRACT

A rotary heating apparatus to heat evenly symmetrical and/or non-symmetrical workpieces. A rotatable shaft holds directly or indirectly one or more workpieces. The shaft has a first major central elongated axis. An induction coil providing a magnetic field and has a second major central elongated axis. The coil is fabricated with an open space in a side of the coil. The open space is configured and dimensioned to accommodate the passage of the shaft while avoiding contact between the shaft and any portion of the coil. The shaft is arranged so that said first major axis is positioned perpendicular to the second major central elongated axis. The shaft rotates workpieces within the coil in a plane which includes the second axis or in a plane which is parallel to the axis so that the rotating workpiece crosses through multiple lines of flux of the magnetic field to ensure even exposure of the workpiece to the magnetic field provided by the coil for consistent uniform heating of the workpiece regardless of different thicknesses of the workpiece.

10 Claims, 3 Drawing Sheets

ROTARY HEATING APPARATUS, AND METHODS OF MAKING AND USING SAME

CROSS REFERENCE TO RELATED APPLICATION

The present patent application is based on and claims priority from U.S. Provisional Patent Application Ser. No. 62/395,435 filed Sep. 16, 2016.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The present invention relates generally to a rotary heating apparatus, and methods of making and using same.

More particularly, the present invention relates to a rotary heating apparatus to heat evenly symmetrical and/or non-symmetrical workpieces, and methods of making and using same.

Induction heating often fails to give uniform heat, especially with non-symmetrical parts or workpieces.

Uneven heating is unacceptable for many applications, such as, for example, heating for quenching, intensive quenching, Ausforging, forging, heating for ring rolling, and coating applications.

Rotation inside an induction coil has been used for years. However, this "conventional" approach uses rotation for the part or workpiece coming into an open end of an induction coil.

It is a desideratum of the present invention to avoid the animadversions of conventional induction heating equipment and techniques, and to provide a novel and unique rotary heating apparatus which heats evenly symmetrical and/or non-symmetrical workpieces, and methods of making and using same.

SUMMARY OF THE INVENTION

The present invention provides a rotary heating apparatus to heat evenly symmetrical and/or non-symmetrical workpieces, comprising, in combination: a rotatable shaft for holding directly or indirectly one or more workpieces to be heated; said rotatable shaft having a first major central elongated axis; an induction coil providing a magnetic field therewithin and having a second major central elongated axis; said induction coil being fabricated with an open space in a side of said induction coil; said open space being configured and dimensioned to accommodate the passage therethrough of said rotatable shaft while avoiding contact between said rotatable shaft and any portion of said induction coil; said rotatable shaft being constructed and arranged so that said first major central elongated axis is positioned perpendicular to said second major central elongated axis; and said rotatable shaft rotates one or more workpieces within said induction coil in a plane which includes said second major central elongated axis of said induction coil or in a plane which is substantially parallel to said second major central elongated axis of said induction coil so that the rotating workpiece crosses through multiple lines of flux of the magnetic field to ensure even exposure of the workpiece to the magnetic field provided by said induction coil for consistent uniform heating of the workpiece regardless of different thicknesses of the workpiece.

The present invention also provides a rotary heating apparatus to heat evenly symmetrical and/or non-symmetrical workpieces, comprising: an induction coil providing a magnetic field therewithin and having opposite open ends thereof and a major central elongated axis; first means for positioning a workpiece through an open space in a side of said induction coil and remote from said opposite open ends of said induction coil; and said first means being constructed and arranged to rotate the workpiece within said induction coil in a plane which includes said major central elongated axis of said induction coil or in a plane which is substantially parallel to said major central elongated axis of said induction coil so that the rotating workpiece crosses through multiple lines of flux of the magnetic field to ensure even exposure of the workpiece to the magnetic field provided by said induction coil for consistent uniform heating of the workpiece regardless of different thicknesses of the workpiece.

It is a primary object of the present invention to provide a rotary heating apparatus to heat evenly symmetrical and in particular non-symmetrical (irregular) shaped workpieces or parts using induction heating.

Another object of the invention is to provide an induction heating apparatus wherein rotation of the part(s) takes place within an induction coil to evenly heat the part to temperature.

An object of the invention is to provide a rotary heating apparatus as described above, wherein: said induction coil has opposite open ends thereof; and said open space in a side of said induction coil is positioned substantially midway between said opposite open ends of said induction coil.

Another object is to provide a rotary heating apparatus as described above, wherein the rotatable shaft holds directly thereon a workpiece to be heated in said induction coil.

A further object is to proved a rotary heating apparatus as described above, wherein the rotatable shaft supports a refractory platen which holds thereon one or more workpieces to be heated in the induction coil.

In another aspect, the invention also provides a rotary heating apparatus as described above, wherein: said major central elongated axis of said induction coil is oriented substantially horizontally; said first means includes a rotatable shaft which directly holds the workpiece; and said rotatable shaft is oriented substantially perpendicular to said major central elongated axis of said induction coil.

A further object is to provide an apparatus as described above wherein the rotation is done through the turns or "side" of the induction coil.

Another object is to provide an apparatus as described above by orienting the part and rotation in such a manner that the part's rotation crosses through multiple different lines of flux, and the continuous rotation through a fixed magnetic field ensures even exposure to flux field for consistent uniform heat.

A further object is to provide an apparatus as described above wherein the rotation of the part may be accomplished with a straight shaft through an open space in the side of the electrical turns of the coil, whereby the shaft may hold the part directly or the part may be placed on a refractory turntable mounted on the end of the shaft.

Other objects, advantages, and features of the present invention will become apparent to those persons skilled in this particular area of technology and to other persons after having been exposed to the present patent application when read in conjunction with the accompanying patent drawings.

DETAILED DESCRIPTION OF THE INVENTION

The following detailed description is of the best currently-contemplated modes of carrying out exemplary embodiments of the invention.

The description is not to be taken in a limiting sense, but is made merely for the purpose of illustrating the general principles of the invention.

Figure 1:
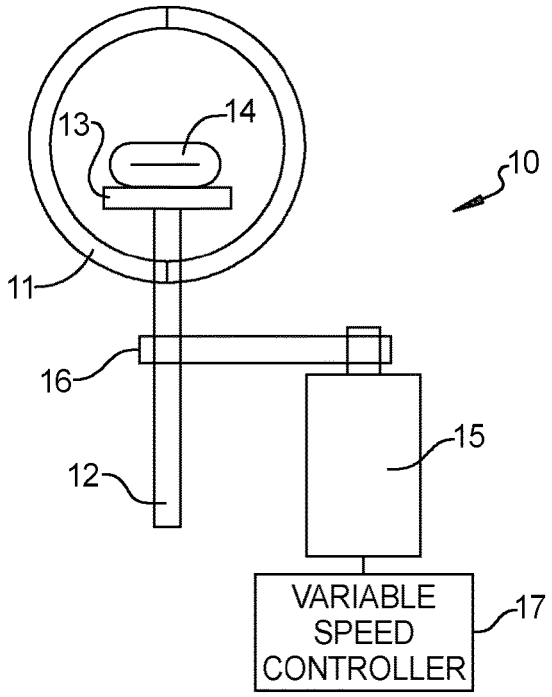
FIG. 1 is a schematic view of a first embodiment of the present invention.

With reference to FIG. 1, there is shown a rotary heating apparatus 10 in accordance with a first embodiment of the present invention, which includes an induction coil 11, a rotatable shaft 12 upon which is mounted a refractory platen 13 for supporting a workpiece 14 to be heated in the coil 11, a drive motor 15 and a mechanical drive system 16 for rotating the shaft 12, and a variable speed controller 17 connected to the motor 15.

Figure 2:
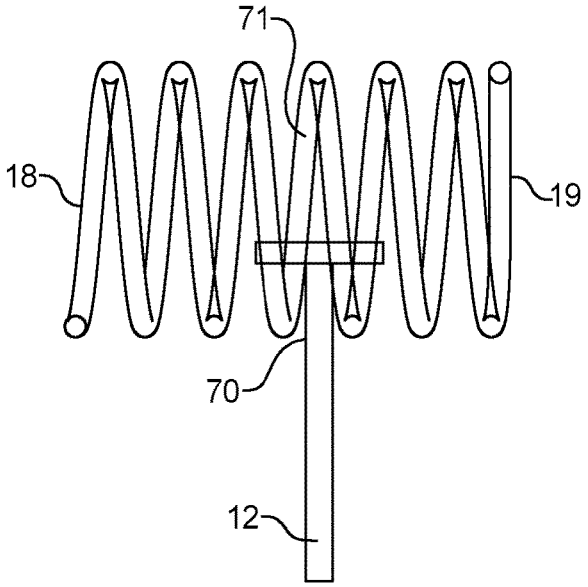
FIG. 2 is a schematic elevational view of some of the components of FIG. 1.

FIG. 2 shows the coil 11, the shaft 12, and the platen 13.

Figure 3:
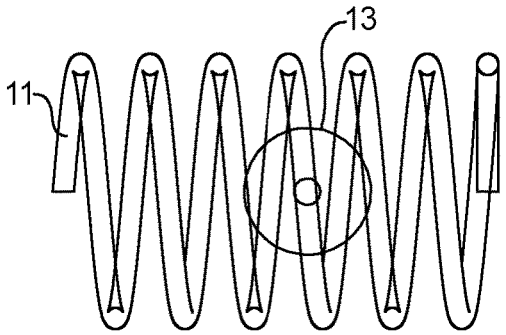
FIG. 3 is a top plan view of FIG. 2.

FIG. 3 shows the coil 11 and the platen 13.

Figure 4:
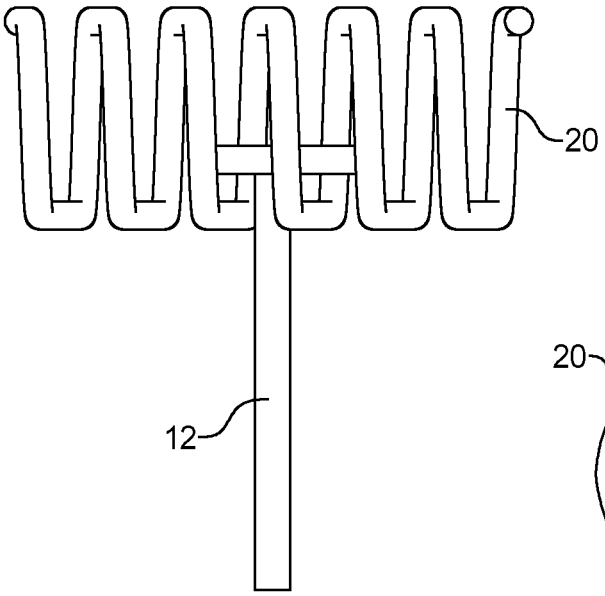
FIG. 4 is a schematic view of a second embodiment of the present invention.
Figure 5:
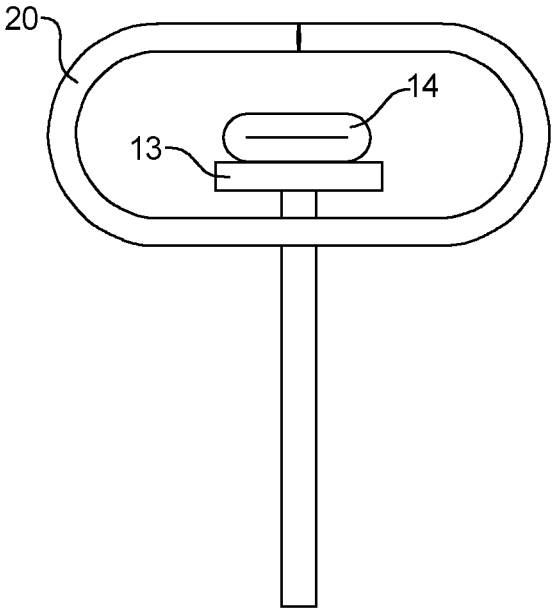
FIG. 5 is an end view of FIG. 4 with a workpiece supported by the refractory platen.
Figure 6:
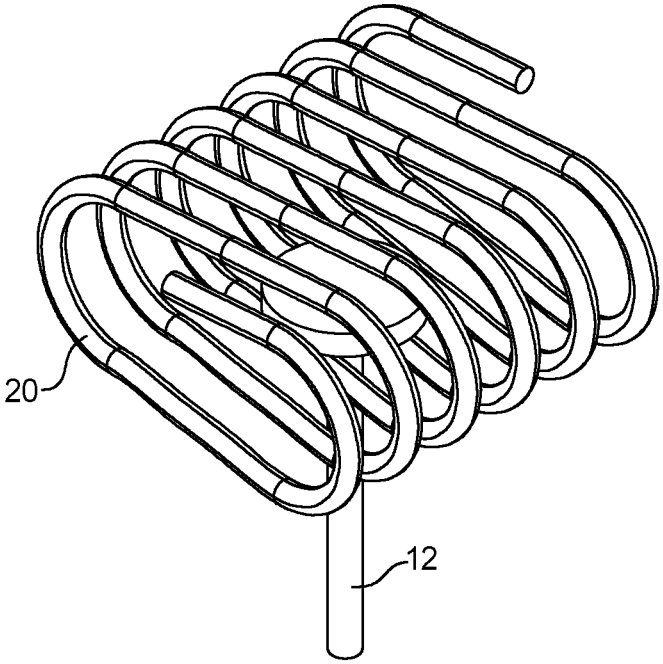
FIG. 6 is a perspective view of the FIG. 4 embodiment.
Figure 7:
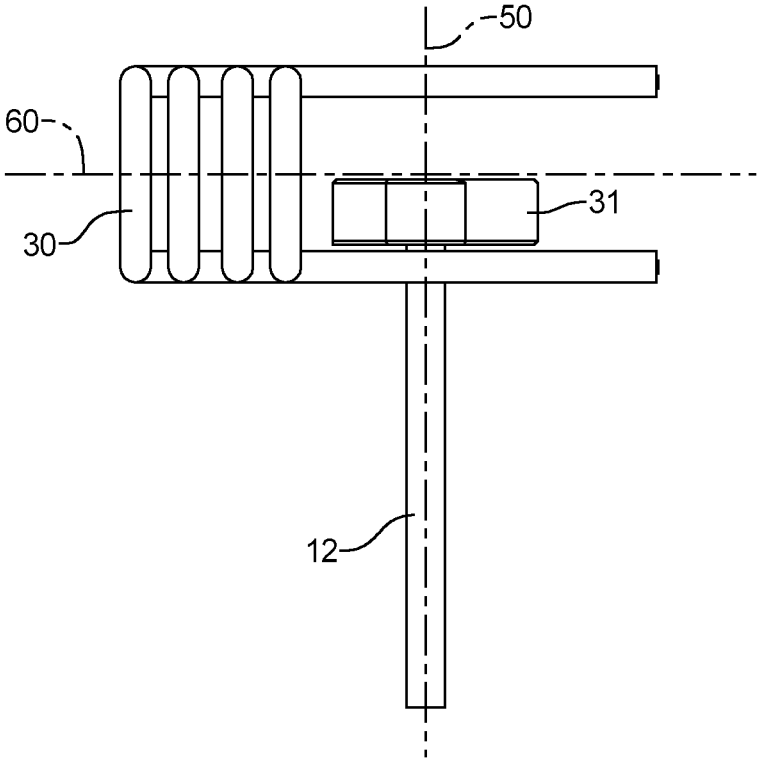
FIG. 7 is a schematic view of a third embodiment of the present invention showing a workpiece supported directly by the rotatable shaft.

FIGS. 4-6 illustrate a second embodiment with an oval shaped induction coil 20. FIG. 7 is a schematic view of a third embodiment of the present invention showing a different shaped induction coil 30, and a workpiece 31 supported directly by the rotatable shaft 12.

Figure 8:
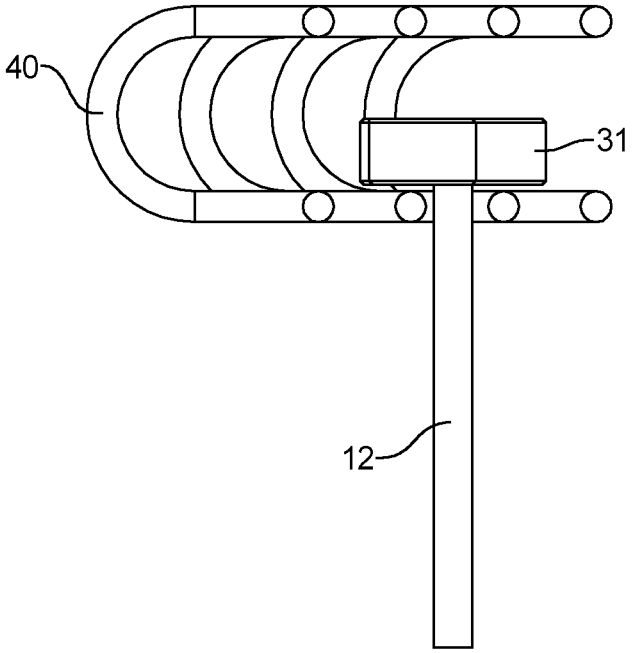
FIG. 8 is a schematic view of a fourth embodiment of the present invention showing a channel-shaped induction coil, and a workpiece supported directly by the rotatable shaft.

FIG. 8 is a schematic view of a fourth embodiment of the present invention showing a channel-shaped induction coil 40, and a workpiece 31 supported directly by the rotatable shaft 12.

The present invention thus provides a rotary heating apparatus 10 to heat evenly symmetrical and/or non-symmetrical workpieces 14 or 31, comprising, in combination: a rotatable shaft 12 for holding directly or indirectly one or more workpieces 14 or 31 to be heated; the rotatable shaft 12 having a first major central elongated axis 50 (see FIG. 7); an induction coil 11, 20, 30 or 40 providing a magnetic field therewithin and having a second major central elongated axis 60 (see FIG. 7); the said induction coil 11, 20, 30 or 40 being fabricated with an open space 70 in a side 71 of the induction coil 11, 20, 30 or 40; the open space 70 being configured and dimensioned to accommodate the passage therethrough of the rotatable shaft 12 while avoiding contact between the rotatable shaft 12 and any portion of the induction coil 11, 20, 30 or 40; the rotatable shaft 12 being constructed and arranged so that the first major central elongated axis 50 is positioned perpendicular to the second major central elongated axis 60; and the rotatable shaft 12 rotates one or more workpieces 14 or 31 within the induction coil 11, 20, 30 or 40 in a plane which includes the second major central elongated axis 60 of the induction coil or in a plane which is substantially parallel to the second major central elongated axis 80 of the induction coil so that the rotating workpiece 14 or 31 crosses through multiple lines of flux of the magnetic field to ensure even exposure of the workpiece 14 or 31 to the magnetic field provided by the induction coil 11, 20, 30 or 40 for consistent uniform heating of the workpiece 14 or 31 regardless of different thicknesses of the workpiece 14 or 31.

With reference to FIG. 2, induction coil 11 has opposite open ends 18 and 19 thereof, and the open space 70 in the side 71 of the induction coil 11 is positioned substantially midway between the opposite open ends 18 and 19 of the induction coil 11.

As shown in FIGS. 7 and 8, the rotatable shaft 12 may hold directly thereon the workpiece 31 to be heated in the induction coil 11.

Alternatively, as shown in FIGS. 1 and 5, the rotatable shaft 12 supports the refractory platen 13 which holds thereon one or more workpieces to be heated in the induction coil.

The drive system is mechanically and operably connected to the rotatable shaft 12 for rotating the rotatable shaft.

The variable speed controller 17 is operably connected to the drive system for controlling the speed of rotation of the rotatable shaft 12.

The rotational speed control is important and is set with the variable speed controller 17 determined by customer specifications.

The platen or turntable 13 is fabricated from a material which resists being heated by the induction coil.

The rotatable shaft 12 may be fabricated from ceramic or any other non-conductive material.

Alternatively, the shaft 12 may be a water-cooled stainless steel shaft.

While the present invention has been described in detail with reference to only several particular embodiments thereof, it should be understood that this has been described by way of illustration only, and not by way of limitation.

Reasonable variation and modification are possible within the spirit of the foregoing specification and drawings without departing from the scope of the invention which is defined in the accompanying claims.

The present invention embraces all embodiments, modifications, variations and changes which come within the scope of the patent claims set forth hereinbelow.

The invention claimed is:

1. A rotary heating apparatus to heat evenly symmetrical and/or non-symmetrical workpieces, comprising, in combination:

an induction coil providing a magnetic field therewithin and having opposite open ends thereof and a major central elongated axis;

first means for positioning a workpiece through an open space in a side of said induction coil and remote from said opposite open ends of said induction coil;

said first means being constructed and arranged to rotate the workpiece within said induction coil in a plane which includes said major central elongated axis of said induction coil so that the rotating workpiece crosses through multiple lines of flux of the magnetic field to ensure even exposure of the workpiece to the magnetic field provided by said induction coil for or in a plane which is substantially parallel to said major central elongated axis of said induction for consistent uniform heating of the workpiece regardless of different thicknesses of the workpiece; and said major central elongated axis of said induction coil is oriented substantially horizontally;

said first means includes a rotatable shaft which holds the workpiece; and said rotatable shaft is oriented substantially perpendicular to said major central elongated axis of said induction coil.

2. The rotary heating apparatus according to claim 1, wherein:

said first means includes a turntable fabricated from a material which resists being heated by said induction coil.

3. The rotary heating apparatus according to claim 1, wherein:

said first means includes a rotatable shaft and a turntable fabricated from a material which resists being heated by said induction coil; and said turntable supports the workpiece.

4. The rotary heating apparatus according to claim 1, including:

second means operably connected to said first means for controlling rotational speed of said first means.

5. The rotary heating apparatus according to claim 4, wherein:

said shaft directly holds the workpiece.

6. A rotary heating apparatus to heat evenly symmetrical and/or non-symmetrical workpieces, comprising, in combination:

an induction coil providing a magnetic field therewithin and having opposite open ends thereof and a major central elongated axis;

first means for positioning a workpiece through an open space in a side of said induction coil and remote from said opposite open ends of said induction coil;

said first means being constructed and arranged to rotate the workpiece within said induction coil in a plane which includes said major central elongated axis of said induction coil or in a plane which is substantially parallel to said major central elongated axis of said induction coil so that the rotating workpiece crosses through multiple lines of flux of the magnetic field to ensure even exposure of the workpiece to the magnetic field provided by said induction coil for consistent uniform heating of the workpiece regardless of different thicknesses of the workpiece;

said first means includes a rotatable shaft;

said major central elongated axis of said induction coil is oriented substantially horizontally; and said rotatable shaft is oriented substantially perpendicular to said major central elongated axis of said induction coil.

7. The rotary heating apparatus according to claim 6, including:

second means operably connected to said first means for controlling rotational speed of said first means.

8. The rotary heating apparatus according to claim 7, wherein: said first and second means provide continuous rotation of the workpiece through a fixed magnetic field ensuring even exposure of the workpiece to the flux field for consistent uniform heat.

9. The rotary heating apparatus according to claim 7, wherein:

said shaft directly holds the workpiece.

10. The rotary heating apparatus according to claim 6, which further includes:

a turntable fabricated from a material which resists being heated by said induction coil; and said turntable supports the workpiece.

* * * * *